United States Patent [19]

Cole et al.

[11] Patent Number: 4,494,951

[45] Date of Patent: Jan. 22, 1985

[54] FLAMEPROOFING TEXTILES

[75] Inventors: Robert Cole, Dudley; James E. Stephenson, Birmingham, both of England

[73] Assignee: Albright & Wilson Limited, Warley, England

[21] Appl. No.: 423,052

[22] Filed: Sep. 24, 1982

[30] Foreign Application Priority Data

Sep. 28, 1981 [GB] United Kingdom ..... 8129272

[51] Int. Cl.[3] ..... D06M 13/26; C09K 3/28; B05D 3/04

[52] U.S. Cl. ..... 8/195; 427/341

[58] Field of Search ..... 8/116 P; 427/341

[56] References Cited

U.S. PATENT DOCUMENTS

| | | | |
|---|---|---|---|
| 3,799,738 | 3/1974 | Wagner | 8/181 |
| 3,846,155 | 11/1974 | Wagner | 427/182 |
| 3,860,439 | 1/1975 | Wagner | 427/337 |
| 3,933,122 | 1/1976 | Wagner | 118/718 |
| 4,068,026 | 1/1978 | Wagner | 8/116 P |
| 4,078,101 | 3/1978 | Cole | 427/341 |
| 4,123,574 | 10/1978 | Wagner | 8/116 P |
| 4,137,346 | 1/1979 | Wagner | 427/341 |
| 4,145,463 | 3/1979 | Cole | 427/337 |
| 4,154,890 | 5/1979 | Wagner | 8/116 P |
| 4,156,747 | 5/1979 | Wagner | 427/341 |

FOREIGN PATENT DOCUMENTS

| | | |
|---|---|---|
| 0023469 | 2/1981 | European Pat. Off. . |
| 2343796 | 10/1977 | France . |
| 938989 | 10/1963 | United Kingdom . |
| 981098 | 1/1965 | United Kingdom . |
| 1131899 | 10/1968 | United Kingdom . |
| 1571617 | 7/1980 | United Kingdom . |
| 1571616 | 7/1980 | United Kingdom . |

*Primary Examiner*—Maria Parrish' Tungol

*Attorney, Agent, or Firm*—Frishauf, Holtz, Goodman & Woodward

[57] ABSTRACT

The cure efficiency for the treatment of fabrics with tetra(hydroxymethyl) phosphonium compounds and their precondensates e.g. with urea especially from THP sulphate, is improved by passing gaseous ammonia through impregnated fabric then wetting the fabric and completing the cure with more ammonia, preferably again passed it through the fabric.

16 Claims, No Drawings

FLAMEPROOFING TEXTILES

The present invention relates to the flameproofing of textile fabrics in particular with tetrakis(hydroxymethyl)phosphonium compounds (hereinafter described as THP compounds).

The THP compounds or precondensates thereof with nitrogen containing compounds such as urea are impregnated in aqueous solution into the fabrics, which are then dried and cured, e.g., by heating or treatment with ammonia. The benefit of the process is that the flameproofing is durable and can withstand repeated washings, but only when the THP residues are cured to an insoluble polymer. Initially the cure was long by heating or passage through an atmosphere of ammonia. The cure process became more efficient when the two step process, with gaseous ammonia first then aqueous ammonia, was introduced (see U.S. Pat. No. 2,983,623). A faster cure with gaseous ammonia only was achieved according to BP 1439608 when the impregnated fabric was passed over a perforated duct in a closed chamber, ammonia issuing through the perforations thereby passing through the fabric to cure it. Alternatively the impregnated fabric can be cured by passage through an atmosphere of gaseous ammonia as described in U.S. Pat. No. 3,846,155 but this gives problems due to formaldehyde productions. To overcome these problems, there is described in U.S. Pat. No. 4,068,026 a process in which the impregnated fabric is first well dried, then aerated, treated by diffusion with gaseous ammonia, wetted with water and then re-ammoniated by diffusion; preferably the two ammoniations and wetting all occur in the same enclosed chamber.

These known processes and those commercially used can give adequate cure, but not complete cure i.e. not complete fixation of all the THP compound applied on the fabric; the expensive THP compound, which is not fixed is therefore wasted.

We have now obtained a process which gives improved more complete fixation that is a higher percentage of the applied THP compound is insolubilized on the fabric, coupled with a low ammonia usage. We have found that with, for example a THP sulphate/urea precondensate, greatly improved curing can be achieved when the impregnated fabric is first passed over ducts carrying orifices through which ammonia issues, then the partly cured fabric is wetted with water and then the fabric is treated again with ammonia. The present invention provides a process for flameproofing a cellulosic textile fabric, which comprises impregnating said fabric with an aqueous solution of pH 4–8 comprising a tetrakis(hydroxymethyl)phosphonium compound or a precondensate thereof with a nitrogen containing compound in a molar ratio of nitrogen containing compound to tetrakis(hydroxymethyl)phosphonium group of 0.05–0.5:1, drying the impregnated fabric, treating the fabric by passing it in contact with at least one duct having at least one orifice, through which gaseous ammonia is caused to issue and pass through the fabric, when wetting the treated fabric to give it a moisture content of 10–60%, and treating the wetted fabric with gaseous ammonia, the wetting and subsequent treatment with gaseous ammonia being optionally combined together in the contact of the treated fabric with aqueous ammonia. Advantageously the ammonia treatment of the wetted fabric also involves passing it in contact with at least one duct having at least one orifice, through which ammonia is caused to issue and pass through the fabric.

The THP compound may be used as such or may be precursor for the precondensate. The THP compound may be a THP salt of an acid with only one acidic hydrogen atom e.g. hydrochloric acid but is preferably the THP salt of an acid with at least two acidic hydrogen atoms e.g. 2–4 and especially 2 or 3 such atoms. The acid may be inorganic such as phosphoric or preferably sulphuric or maybe organic such as an aliphatic carboxylic di, tri or tetra acid e.g. oxalic acid or an alkane dicarboxylic acid with 3–8 carbon atoms such as succinic, or alternatively a hydroxy substituted derivative thereof e.g. tartaric acid. THP sulphate is preferred and is usually reacted in the form of an aqueous solution comprising THP salt, and a little tris (hydroxy methyl) phosphine, free formaldehyde and free acid in equilibrium. The precondensation is usually performed with the aqueous solution having a pH of 4.0–6.5 by adjustment of the pH of a solution of the THP salt with base if necessary (as described in our British Published Patent Application No. 2040299), but if desired the pH may be 0.5–4.0. The precondensation is preferably carried out by heating the solution of THP compound and nitrogen containing compound at 40°–110° C. for 5–100 mins. The nitrogen containing compound may be a compound suitable for the purpose as described in BP Nos. 740269, 761985 or 906314; such compounds are ones capable of condensing with THP groups to give a water soluble precondensate which itself can be cured to an insoluble polymer with ammonia. Examples are urea, thiourea, biuret, and melamine, ethylene-urea or -thiourea, propylene-urea or -thiourea, as well as hydroxymethyl derivatives of these compounds. Urea is preferred. The molar ratio of the nitrogen containing compound to THP group is 0.05–0.5:1 e.g. 0.1–0.35:1. If desired extra THP compound or nitrogen containing compound may be added to a preformed precondensate to adjust the molar ratio to the desired amount. The impregnation solution may contain 10–60% e.g. 20–50% by weight of the precondensate and is at pH 4–8, preferably 4–6.5 in the case of the precondensates and 6.5–8 or 6.5–7.5 in the case of the uncondensed THP compound.

The fabric to be treated comprises at least 40% by weight (based on the total weight of fibres) of cellulosic fibres, but while cotton is preferred, there may be up to 60% (based on the total weight of fabric) of other fibres e.g. polyesters or wool e.g. up to 50% of polyesters. The cotton fabric may be of any weight and style of weaving, e.g. wincyette fabrics of 100–200 g/m$^2$.

The impregnation is usually performed by padding, though other techniques e.g. dipping or spraying may be used. After impregnation any excess of solution is removed e.g. with a mangle to leave a wet fabric with 30–150% added on e.g. a 50–100% wet pick up (expressed as the difference between the weights of the wet fabric and fabric before impregnation divided by the weight of the fabric before impregnation expressed as a percentage).

The impregnated fabric is then dried e.g. by passing over heated rollers or through ovens to reduce the moisture content of the fabric e.g. to 0–40% or 0–30% such as 10–30% or 10–25% or especially 10–20% (expressed as the difference between the dried weight of the fabric and the theoretical fully dried weight of the fabric, divided by the weight of the original unimpregnated fabric). The theoretical fully dried weight is calculated from the wet pick up of the fabric, the solids content of the impregnation solution and the original weight of the fabric before impregnation. Drying to 10–30% or 10–20% moisture content enables the first ammoniator step to achieve maximum cure so that less cure is needed in the second step; drying to these contents also gives processes that are less sensitive to the variations in drying conditions routinely found in commercial textile drying operations. After drying the fabric is usually hot, and then, usually without aeration by passing air through the fabric, the dried fabric (which may be hot or may have cooled to room temperature) is then treated with ammonia. The fabric is passed over ducts, having one or more orifices through which ammonia issues and passes through the fabric. The orifices in the ducts are preferably arranged such that substantially all the ammonia passes into the chamber through the fabric. While the ducts may be in a chamber provided for exit of gases with an exhaust pipe and exhaust fan or other exhaustion means for removing the gases, the gases may leave through a pipe under the influence of any pressure difference between inside and outside the chamber. Preferably the ducts are in a substantially closed chamber with seals through which the fabric enters and leaves the chamber. There may be used a chamber as described and claimed in our British Patent No. 1439609 the disclosure of which is herein incorporated by reference; this has two ducts each with orifices distributed over its width to ensure even distribution of ammonia into and through the fabric, and means to stop water dripping unevenly onto the partly cured fabric. The time for this first treatment with ammonia is usually 1–10 secs. At the end of this first treatment the fabric preferably has a moisture content of 5–25% (expressed as above).

The partly treated fabric is then wetted with water to give it a moisture content of 10–60% e.g. 20–50% or 20–40% or 25–50% (expressed in the same terms as given above) and determined in the same way. The moisture content of the wetted fabric is usually higher than that of the dried impregnated fabric before the first ammonia treatment. The water may be applied by spraying or other minimum add-on technique such as application of a thin film of water e.g. with a lick roller or blade. If the wetting has applied too much water, the moisture content can be reduced again by partial drying. The water which is applied is advantageously at 0°–40° C. and if warmer water is used the wetted fabric is advantageously allowed to reach 10°–40° C. before the next stage.

The wetted fabric is subsequently retreated with gaseous ammonia, the latter simply in an enclosed chamber with the fabric being passed through, or with ammonia passing through the fabric e.g. emitting from orifices in a duct over which the fabric passes causing the ammonia to pass through the fabric, e.g. as in the first ammonia treatment stage. Advantageously the second ammonia treatment stage is in a substantially closed chamber with the orifice containing a duct or ducts therein; apparatus as in the first stage e.g. as described and claimed in British Patent No. 1439609 may be used. Usually at least 50% e.g. 60–90% of the cure occurs in the first ammonia treatment stage.

The relative total amount of ammonia used to cure the impregnated fabric to phosphorus applied to the fabric may be from 0.5–20:1 e.g. 0.8–10:1 such as 1.5–5:1 and especially 1.5–3.5 or 1.5–2.8:1 (expressed as an atom ratio of N (from ammonia) to P (from THP residues). The amount of ammonia to P in the first ammoniation stage may be 0.4–10:1 e.g. 1–5:1 and especially 1–2.5:1, while in the second ammoniation stage the amount of ammonia to P may be 0.1–10:1 e.g 0.4–5:1 and especially 0.4–2:1, all these amounts being expressed as before. Using the present process, it may be possible to achieve substantially complete cure e.g. fixation on the fabric of 93% or more of the applied phosphorus, with a wide range of total ammonia to P atom ratios but in particular a very low one of 1.5–2.8:1. In contrast according to BP No. 1439608/9, it has proved possible under otherwise corresponding conditions with e.g. THP sulphate/urea precondensates only to obtain a maximum of 80% fixation even with an ammonia to P atom ratio higher than 3:1. The use of the lower ammonia to P ratios in the present process can enable fabric to be processed at higher speeds than before (e.g. three times higher) for a given total ammonia input and reduces the problems of environmental pollution which can arise when using high ammonia to P ratios.

Preferably the cellulosic textile fabric is impregnated with an aqueous solution at pH 4–6.5 comprising a precondensate of urea and tetrakis hydroxymethyl phosphonium compound in a molar ratio of 0.1:1 to to 0.35:1, the impregnated fabric is dried to 10–20% moisture content, the dried fabric is treated with an amount of ammonia of 1:1 to 2.5:1 (expressed as an atom ratio of N to P) the treated fabric is wetted with water to a moisture content of 20–50%, and the wetted fabric is treated with gaseous ammonia by passing it through the fabric, the total ammonia to P atom ratio being 1.5:1 to 5:1.

The relation between the first and second ammoniation steps and the wetting step may be as follows. All three steps may be performed in the same apparatus with a substantially closed chamber, having entry and exit seals, 2 or more perforated ducts therein emitting ammonia and means for wetting the fabric e.g. a minimum water add on device such as a spray. The impregnated fabric passes through the entry seal, travels over 1 or more of the ducts, then is wetted with the water spray, passes over one or more of the ducts and then leaves the chamber by way of the exit seal. Alternatively the wetting means may be in a part of the chamber separate from that part of the chamber containing the ammonia duct; advantageously the two parts of the chamber are separated by ammonia seals. In one form of the process the first ammonia treatment is carried out in one ammoniator, the treated fabric is then wetted outside said ammoniator and in a non closed area, open to the air, and then the wetted fabric is then passed into a second ammoniation step, which may be in a second ammoniator or simply the first one reused, so the fabric passes twice through the same ammoniator.

It is possible also to combine the wetting and second ammoniation stage by contacting the treated fabric from the first ammoniator with aqueous ammonia in amount to wet the fabric to the desired extent as well as to complete the curing. This operation may conveniently be performed in a minimum add-on technique by contacting the fabric with a thin film of aqueous ammonia e.g. with a lick roller or blade.

After the second ammonia treatment step, the treated fabric is usually post treated, as is conventional, by washing and scouring rinsing and drying.

The invention may be performed as illustrated in the accompanying Examples in which an ammonia cure apparatus as illustrated in BP 1439609 which corresponds to U.S. Pat. No. 4,145,463 was used.

A THP/urea precondensate was made by heating together for 1 hr. at 100° C. an aqueous solution of THP sulphate and urea in a molar ratio of urea to THP ion of 0.25:1. An aqueous solution of this precondensate at pH 5.1 contained the equivalent of 33.8% THP sulphate (when analyzed for reducing species with iodine). This solution was used to impregnate a printed unscoured cotton winceyette fabric of 160 g/m$^2$ by padding, and then with subsequent removal of excess of solution to given about an 80% wet pick up corresponding to an add-on of precondensate equivalent to about 27% THP sulphate. The wet fabric was then dried for 2 mins at 95° C. and allowed to cool without forced passage of air through the fabric. The fabric was treated with ammonia at a constant rate in the manner given below. The treated cured fabric was then washed off on a jig successively with a cold aqueous solution of hydrogen peroxide (25 cc of 100 volume hydrogen peroxide per liter of water) for 5 mins, then an aqueous solution of sodium carbonate (2 g/l) at 60° C. for 2 mins, and then cold water for 5 mins for rinsing. The fabric was then dried and analysed for N and P. Samples of the dried fabric were also submitted to the BS 3119 Flammability test.

The experiments were done first comparatively (Ex. A-D) with four different fabric speeds i.e. four different ratios of $NH_3$:P. The curing was done by passing the dried impregnated fabric of moisture content given below through an ammoniator as in the Figure of BP No. 1439609.

The experiments were also done according to the process of the invention (Ex. 1–4) with the same four fabric speeds. The dried impregnated fabric was passed as before through the same ammoniator with the same ammonia rate (i.e. the same ratio of $NH_3$:P) and then the fabric was wetted with water by spraying to give an about 15% water pick up (based on the weight of the cured fabric). The wetted fabric was then passed again through the same ammoniator at the same speed with the same ammonia speed. The fabric speeds for the pairs of experiments A,1; B,2; C,3; D,4 were in the ratio 6:3:2:1.

The results were as follows.

TABLE 1

ADD-ON FIGURES

| Example | % Moisture content (1) | % water add-on | % Moisture content (2) | % final add-on |
|---|---|---|---|---|
| A | 18.1 | — | — | 9.95 |
| B | 16.0 | — | — | 12.6 |
| C | 15.7 | — | — | 14.3 |
| D | 14.5 | — | — | 14.7 |
| 1 | 13.6 | 15.4 | 32.6 | 16.7 |
| 2 | 16.2 | 13.8 | 31.8 | 18.2 |
| 3 | 16.3 | 14.3 | 32.5 | 18.0 |
| 4 | 16.7 | 14.8 | 35.5 | 18.1 |

% Water add-on is the percentage increase in weight of the wet fabric in the water wetting stage based on the weight of the fabric after the first cure stage.

% final add-on is the percentage increase in weight of the fabric (after the cure wash and dry stages) over the weight before impregnation.

% Moisture content is $$\frac{[\text{weight of fabric - theoretical fully dried weight}]}{\text{original weight of fabric}} \times 100$$

with column (1) denoting the moisture content of the fabric before the first or only cure step and column (2) denoting the moisture content of the fabric after the wetting step in Ex. 1–4 but before the second cure step.

TABLE 2

ANALYTICAL AND FLAMMABILITY RESULTS

| Example | Total $NH_3$:P Ratio | % P Pick-up | % P final | % P Efficiency | Char Length mm |
|---|---|---|---|---|---|
| A | 1 | 3.26 | 1.91 | 58.5 | BEL |
| B | 2 | 3.30 | 2.35 | 71.2 | 71 |
| C | 3 | 3.21 | 2.51 | 78.2 | 66 |
| D | 6 | 3.24 | 2.60 | 80.2 | 78 |
| 1 | 2 | 3.19 | 3.03 | 95.0 | 72 |
| 2 | 4 | 3.28 | 3.28 | 99.8 | 69 |
| 3 | 6 | 3.26 | 3.16 | 97.0 | 70 |
| 4 | 12 | 3.27 | 3.21 | 98.0 | 76 |

The % P efficiency is the percentage of P present fixed on the cured and washed fabric to that put on the fabric in the impregnation stage.

$NH_3$:P Ratio is the overall $NH_3$ (as N):P atom ratio in the overall curing steps determined from the ammonia flow rate the fabric speed, the % wet pick up the % P in the impregnation solution and the number of times the fabric is contacted with ammonia.

% P Pick up is the calculated weight percentage of P on the fabric after the impregnation step and % P final is the analytically determined weight percentage of P on the final cured, washed and dried fabric.

BEL means Burns Entire Length.

All the cured fabrics of Ex. B–D and 1–4 passed the BS 3119/20 test.

EXAMPLES 5–9

The process of Ex. 1–4 and A-D were repeated but with different curing conditions and curing styles, and drying to different moisture connents by varying the drying times.

In Ex. 5–7, the impregnated and dried fabric was treated with ammonia in a first pass through the above apparatus with an atom ratio of N:P of 1.7:1, then wetted by spraying with add-on water to 20% add-on and then reammoniated through the same apparatus with an atom ratio of N:P of 1.1:1.

In Ex. 8 and 9 the processes of Ex. 5–7 were repeated but with wetting by the minimum add-on technique of applying a thin film of water with a lick roller, rather than spraying.

The results were as follows.

| Example | % moisture Content after drying | % moisture Content after wetting | % Phosphorus Efficiency | Char Length mm. |
|---|---|---|---|---|
| 5 | 1.1 | 37.1 | 101.2 | 59 |
| 6 | 8.4 | 40.4 | 100.6 | 64 |
| 7 | 18.9 | 45.1 | 99.4 | 55 |
| 8 | 15.2 | 41.8 | 100 | 64 |
| 9 | 27.3 | 49.5 | 96.1 | 79 |

The % Phosphorus efficiency was determined as for Example 1–4, as was the char length. All the cured fabrics of Example 5–9 passed flammability test of BS 3119/20.

We claim:

1. A process for flameproofing a cellulosic textile fabric, which comprises impregnating said fabric with an aqueous solution of pH 4–8 comprising a tetrakis(hydroxymethyl phosphonium) compound or a precondensate thereof with a nitrogen containing compound in a molar ratio of nitrogen containing compound to tetrakis(hydroxymethyl)phosphonium group of 0.05–0.5:1, drying the impregnated fabric, treating the fabric by passing it in contact with at least one duct having at least one orifice, through which gaseous ammonia is caused to issue and pass through the fabric, then wetting the treated fabric to give it a moisture content of 10–60%, and then passing said wetted fabric in contact with at least one duct having at least one orifice through which gaseous ammonia is caused to issue and pass through the fabric to give a cured fabric.

2. A process according to claim 1 wherein the fabric is impregnated with an aqueous solution comprising said precondensate.

3. A process according to claim 1 or 2 wherein the tetra hydroxymethyl phosphonium compound is derived from an acid having at least two acidic hydrogen atoms.

4. A process according to claim 3 wherein the compound is tetrakis hydroxymethyl phosphonium sulphate.

5. A process according to claim 1 wherein the impregnated fabric is dried to a moisture content of 10–30%.

6. A process according to claim 5 wherein the treated fabric is wetted to a moisture content of 20–50%.

7. A process according to claim 1 wherein the treated fabric is wetted to a moisture content of 20–50%.

8. A process according to claim 1 wherein the cellulosic textile fabric is impregnated with an aqueous solution at pH 4–6.5 comprising a precondensate of urea and tetrakis hydroxymethyl phosphonium compound in a molar ratio of urea to tetrakis hydroxymethyl phosphonium group of 0.1:1 to 0.35:1, the impregnated fabric is dried to 10–20% moisture content, the dried fabric is treated with an amount of ammonia of 1:1 to 2.5:1 (expressed as an atom ratio of N to P), the treated fabric is wetted with water to a moisture content of 20–50%, and the wetted fabric is treated with gaseous ammonia by passing it through the fabric, the total ammonia to P atom ratio being 1.5:1 to 5:1.

9. A process according to any one of claims 1, 5, 7, and 6 wherein the nitrogen compound in the precondensate is urea.

10. A process according to any one of claims 1, 5, 7, and 6 wherein the molar ratio of nitrogen containing compound which is urea to tetrakis hydroxymethyl phosphonium groups is 0.1:1 to 0.35:1.

11. A process according to any one of claims 1, 5, 7 and 6 wherein the dried fabric is not aerated by passing air through the fabric before treatment with ammonia.

12. A process according to any one of the claims 1, 5, 7, and 6 wherein the total amount of ammonia to phosphorus applied to the fabric is from 1.5:1 to 5:1 (expressed as an atom ratio of N to P).

13. A process according to any one of claims 1, 5, 7 and 6 wherein the dried fabric is treated with an amount of ammonia which is from 1:1 to 5:1 expressed as an atom ratio of N from ammonia to P from tetrakis hydroxymethyl phosphonium residues.

14. A process according to any one of claims 1, 5, 7 and 6 wherein the wetted fabric is treated with an amount of ammonia which is from 0.4:1 to 2:1 expressed as an atom ratio of N from ammonia to P from tetrakis hydroxymethyl phosphonium residues.

15. A process according to any of claims 1, 5, 7 and 6 wherein at least one of the dried and wetted fabrics is treated with ammonia in a substantially closed chamber with means to stop water dripping onto the treated or cured fabric.

16. A process according to any one of claims 1, 5, 7 and 6 wherein the treated fabric is wetted and treated with ammonia in one combined stage by contact of the treated fabric with aqueous ammonia to give a moisture content of the fabric of 20–45%.

* * * * *